US006203566B1

(12) United States Patent
Alanen et al.

(10) Patent No.: US 6,203,566 B1
(45) Date of Patent: Mar. 20, 2001

(54) PACIFIER

(76) Inventors: Pentti Alanen, Papinkatu 18, Fin-32200, Loimaa; Eva Söderling, Hiihtolantie 7, Fin-21290, Rusko, both of (FI)

( * ) Notice: Subject to any disclaimer, the term of this patent is extended or adjusted under 35 U.S.C. 154(b) by 0 days.

(21) Appl. No.: 09/331,253

(22) PCT Filed: Dec. 11, 1997

(86) PCT No.: PCT/FI97/00777

§ 371 Date: Jun. 18, 1999

§ 102(e) Date: Jun. 18, 1999

(87) PCT Pub. No.: WO98/27928

PCT Pub. Date: Jul. 2, 1998

(30) Foreign Application Priority Data

Dec. 20, 1996 (FI) ..... U960626

(51) Int. Cl.[7] ..... A61J 17/00
(52) U.S. Cl. ..... 606/234
(58) Field of Search ..... 606/234, 235; 600/236; 604/77

(56) References Cited

U.S. PATENT DOCUMENTS

| | | | | |
|---|---|---|---|---|
| 2,612,165 | | 9/1952 | Szuderski . | |
| 3,610,248 | | 10/1971 | Davidson . | |
| 5,127,903 | * | 7/1992 | Mailot et al. | 606/236 |
| 5,395,392 | | 3/1995 | Suhonen . | |
| 5,512,047 | | 4/1996 | Dvorak . | |
| 5,620,011 | | 4/1997 | Flowers . | |

* cited by examiner

*Primary Examiner*—Michael Buiz
*Assistant Examiner*—Vy Q. Bui
(74) *Attorney, Agent, or Firm*—Burns, Doane, Swecker & Mathis, L.L.P.

(57) ABSTRACT

The invention is directed to a pacifying or a feeding dummy comprising an actual mouthpiece (10) and a cover piece (11) for attaching the dummy to a feeding bottle. The actual mouthpiece comprises a piece made of an elastic material to be held in the mouth of a baby between the tongue and the palate. The mouthpiece of the pacifying dummy can be either a hollow or a solid piece. The invention is characterized in that the wall (13) of the hollow mouthpiece or the solid mouthpiece has a space (14) formed into it for the insertion of a dosage unit (20) containing an active agent.

19 Claims, 3 Drawing Sheets

PACIFIER

The invention is directed to a baby's pacifying or feeding dummy defined in the introduction of claim 1.

Dental caries has been shown to develop in small children during the sucking of a dummy, especially during the sleep when the secretion of saliva is poor. Therefore, it has been proposed to add an anti-caries agent to a dummy, from which the agent is delivered into the mouth of a baby. Schweiz Monatsschr Zahnmed Vol 104:8 1994 pp 946–951 describes two dummies, where tablets containing sodium fluoride, xylitol, and sorbitol have been inserted. In the first dummy, the downwardly facing surface of the mouth piece had three identical holes through which the active agent flows to an area around the teeth in the lower jaw. In the second dummy, there were two holes made in the downwardly facing surface and also two holes made in the upwardly facing surface, wherein the active agent flowed after its delivery into contact with the teeth in both the upper jaw and the lower jaw.

In both of these dummies, the anti-caries tablet is positioned inside the mouthpiece by means of a locking device situated in the opposing side of the cover piece. However, these approaches for making dummies have certain problems. The insertion of a tablet inside the dummy through the locking device is cumbersome. The locking device itself is structurally rather complicated and thus costly. The difficulty to keep the mouthpiece and the locking device clean creates problems and may lead to an unacceptable hygienic level.

An approach for making dummies has also been presented wherein the anti-caries tablet is placed in the lip-plate. This type of construction is complicated and the plate may exert pressure against the dental alveole, which is unsatisfactory in terms of its growth.

The object of this invention is to overcome the above problems and to provide a dummy, which allows a tablet or a dosage unit containing an anti-caries agent or another active agent to become associatively inserted. The invention is directed to a structurally simple dummy, which is easy to load with a dosage unit containing an active agent and which is easy to clean.

The invention is thus directed to a pacifying or a feeding dummy, which comprises an actual mouthpiece and a cover piece or parts for attaching the dummy to the feeding bottle. The actual mouthpiece comprises a piece made of an elastic material to be held in the mouth of a baby between the tongue and the palate. The mouthpiece of the pacifying dummy may be either a hollow or a solid piece. The invention is characterized in that the wall of a hollow mouthpiece or the solid mouthpiece has a void made into it for the insertion of a dosage unit containing an active agent.

The invention is now described by reference to the attached drawings, wherein

Figure 1:
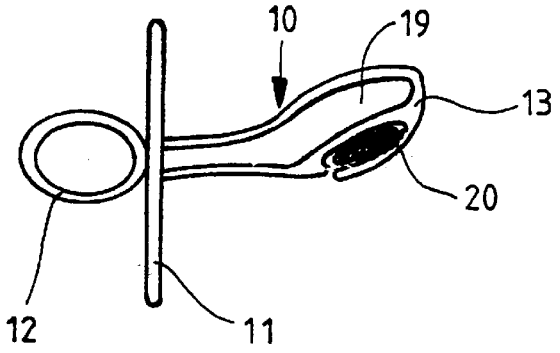
Figure 2:
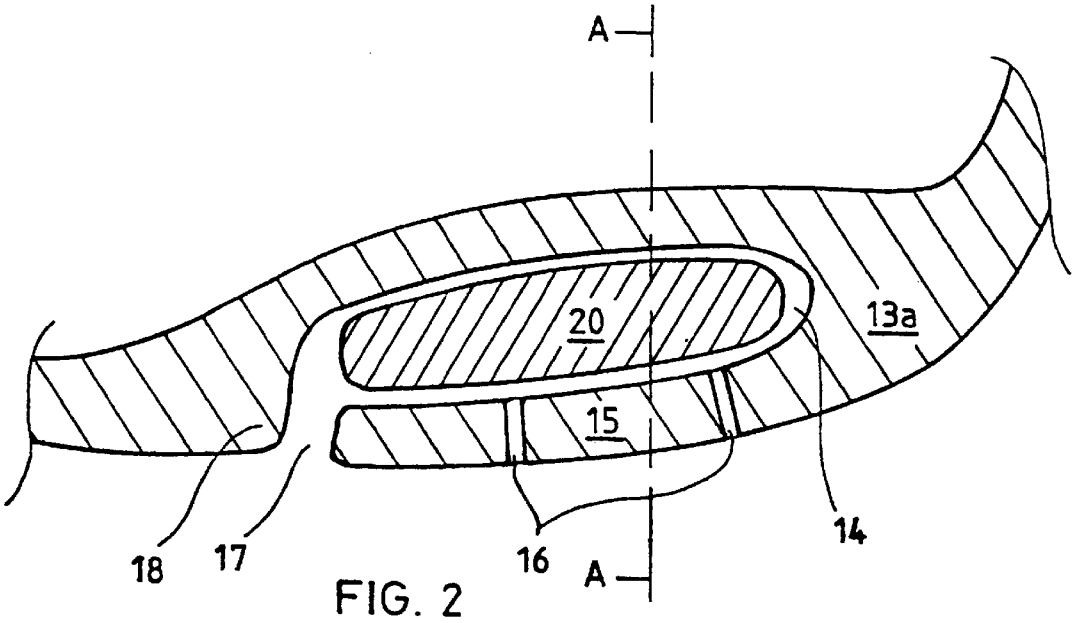
Figure 5A:
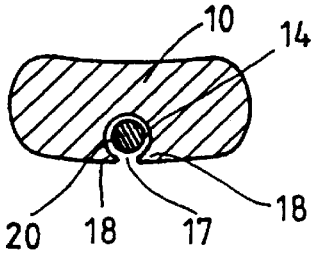
Figure 5B:
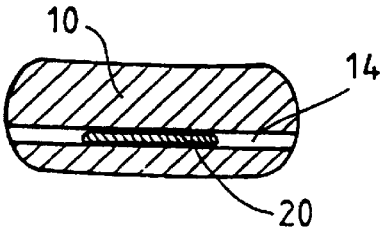
Figure 3:
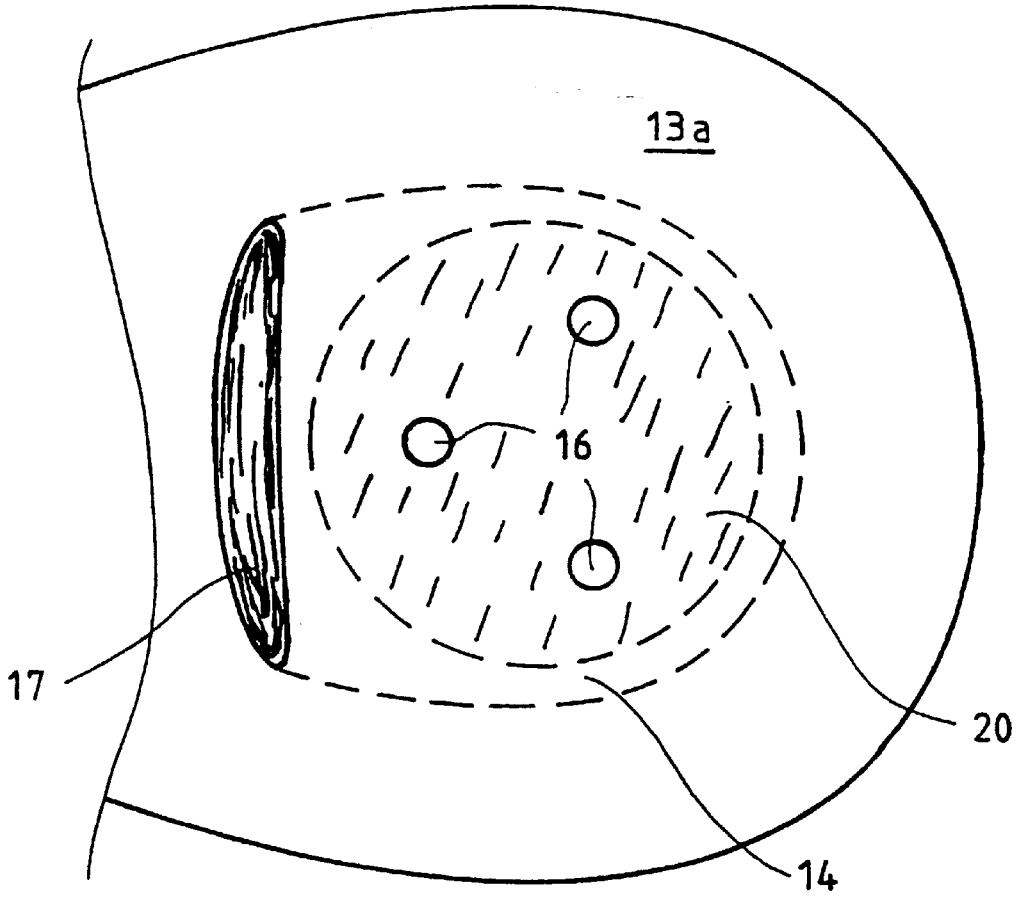
Figure 4:
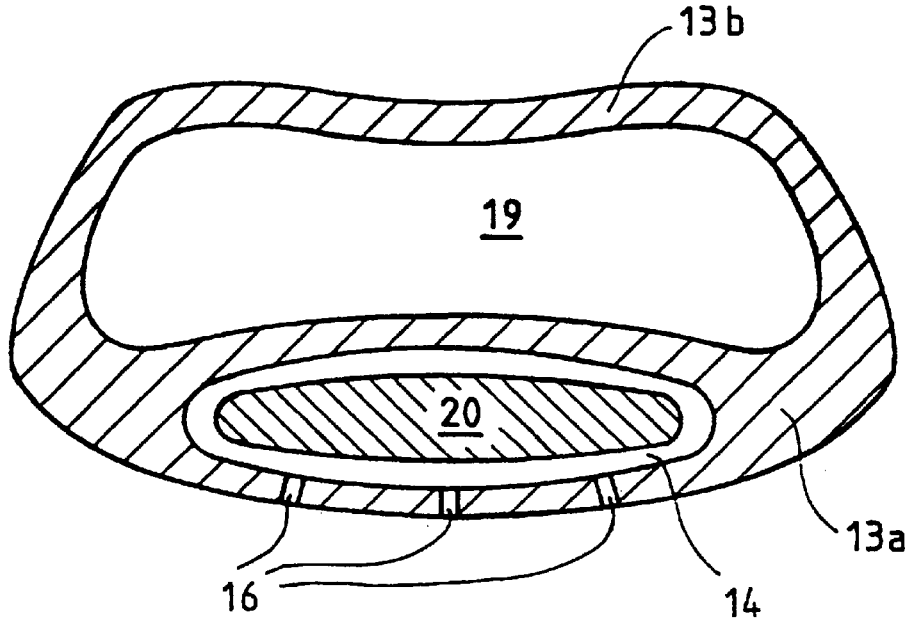

FIG. 1 represents a vertical longitudinal section of a dummy of the invention, FIG. 2 represents a longitudinal section of the mouthpiece of the dummy of FIG. 1, enlarged, FIG. 3 represents the mouthpiece of the dummy of FIG. 2 viewed from the bottom, FIG. 4 represents a vertical cross-section of the mouthpiece of the dummy of FIG. 2 along the line A—A, and FIGS. 5A and 5B represent a section of the dummy of the invention according to the second embodiment.

Figure 6A:
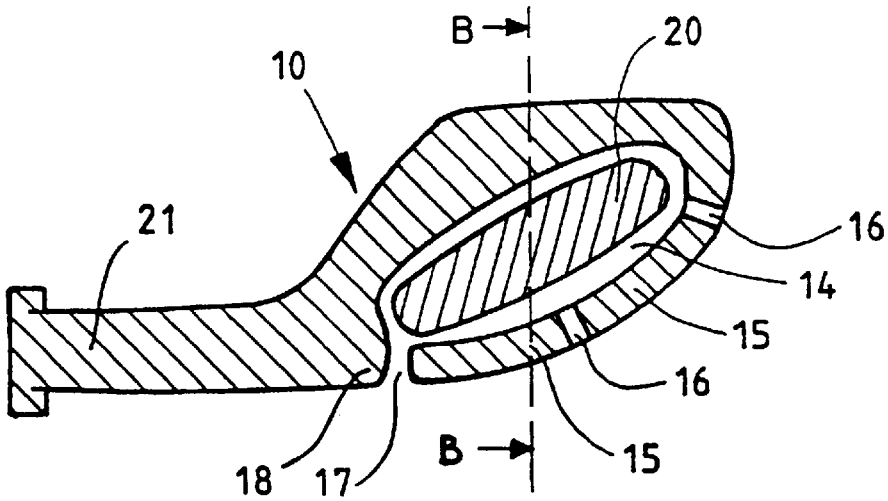
Figure 6B:
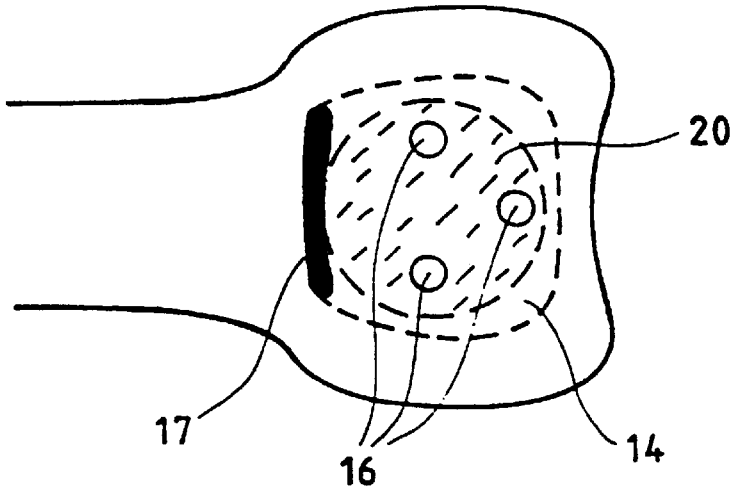
Figure 6C:
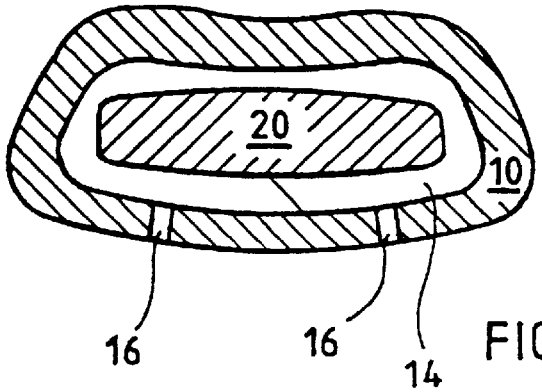

FIGS. 6A–6C represent a section of the dummy of the invention according to the third embodiment.

The FIG. 1 shows a vertical longitudinal section of the dummy of the invention embodied as a pacifying dummy, in approximately natural size. The mouthpiece to be fitted into the mouth of a baby has been given the reference number 10, the cover of the dummy the reference number 11 and the handle the reference number 12. In this embodiment the hollow mouthpiece 10 comprises an empty void 19 defined by an elastic wall forming the outer surface 13 of the mouthpiece. The FIG. 2, which is a greatly enlarged view of the mouthpiece of FIG. 1, shows a closer view of an embodiment of this invention. The wall 13 of the mouthpiece has been provided with a void 14, wherein a tablet 20 or a comparable dosage unit containing an active agent, for example an anti-caries agent, has been inserted.

The void 14, mentioned in the exemplary approach of the FIGS. 1 and 2, is formed as a pouch which has been positioned in the lower part 13*a* of the mouthpiece. The wall 15, facing the mouth of the baby, of the pouch has been provided with one or more holes 16. The active agent is delivered into the mouth of the baby through the hole or holes 16 as a result of its dissolution, erosion, or its disintegration by some other means. The holes allow the rate of introduction of the active agent into the mouth, and thus the concentrations in the mouth, to be controlled for the attainment of a proper therapeutic level. The wall 13 of the mouthpiece is provided with a protuberance 18 at the orifice 17 of the pouch 14. The insertion of the tablet 20 into the pouch 14 is performed by pressing the protuberance 18 outwards from the pouch, thus facilitating the insertion. Thereafter, the protuberance 18 retracts into the position shown in the FIG. 2, when it efficiently prevents the tablet or another dosage unit 20 in the pouch from escaping through the orifice 17 of the pouch into the mouth of the baby. The FIG. 6A shows that the orifice 17 is suitably very narrow as compared to the tablet 20.

The FIG. 4 shows, in a vertical cross-section, the mouthpiece 10, which has a tablet 20 inserted into the lower part 13*a* of its wall. According to a preferred embodiment, the mouthpiece is designed as described in the published patent WO 96/20687. Accordingly, the cross-sectional profile of the mouthpiece is elongated and laterally protruding, which results in a sideways-acting pressure generated by the sucking movements of the baby. According to the said published patent the cross-sectional profile can further be slightly V-shaped or its upper edge (13*b*) arched slightly downwards, which results in a nonsignificant pressure from the mouthpiece against the central part of the palate.

The FIGS. 5A and 5B represent the second embodiment of this invention, wherein the mouthpiece 10 of a pacifying dummy is a solid elastic piece. The FIG. 5A represents a side view of a vertical cross-section of the mouthpiece and the FIG. 5B a front view of a vertical cross-section of the mouthpiece. In this approach the space 14 is a cleft-like cavity into which the dosage unit 20 is pushed. The dosage unit is retained safely by the elastic protuberances 18. Such an approach is not to be recommended if the dosage unit is a disintegrating tablet, because in such a case rather large pieces may be introduced into the mouth of a baby through the orifice 17. However, this approach may well be suitable if the dosage unit remains largely intact during the use, when the active agent is delivered for example though a membrane surrounding the dosage unit. The pouch-based design, instead, shown in the FIGS. 1–4, is to be recommended if an easily disintegrating tablet is concerned, because even the smallest pieces are retained safely inside the pouch.

The FIGS. 6A–6C, representing sections similar to those of the FIGS. 1–2, 3, and 4, show a pouch made into a solid mouthpiece. The FIG. 6A, which is a vertical longitudinal section of the mouthpiece, shows that the part 21 of the mouthpiece, which remains between the alveoli, is made solid and a pouch 14 is formed into the solid rear half. Because the rear half of the mouthpiece is nearly flat and small, the whole rear half has been formed into a pouch in this approach. The construction of this kind of a mouthpiece is simple and the pouch can be easily made wide enough. The FIG. 6B shows the mouthpiece of FIG. 6A from below and the FIG. 6C shows a part of the dummy as a cross-section along the line B—B of FIG. 6A. The reference numbers have the same meaning as in the previous Figures.

A tablet or an another dosage unit can contain an anti-caries agent. Alternatively, the active agent can be an agent against another disease, such as an anti-otitis agent. The active agent can also be a medicament intended for temporary use.

In the case of a pacifying dummy the mouthpiece can be hollow or a solid and elastic piece.

The invention can also be applied to a feeding dummy.

Various embodiments of this invention are evident for a person skilled in the art and these are within the scope of the appended claims.

What is claimed is:

1. A pacifying or a feeding dummy, which comprises a mouthpiece and a cover for attaching the dummy to a feeding bottle, wherein the mouthpiece comprises a piece made of an elastic material to be held in a mouth of a baby between the tongue and the palate and a part to be held between the alveoli in the mouth of a baby and wherein the mouthpiece of the pacifying dummy is either a hollow or a solid piece, the mouthpiece having one end that is to be located in the mouth of the baby, the mouthpiece having a wall that contains a pouch for insertion of an active agent-containing dosage unit and the wall of the mouthpiece having an outside and the pouch including an insertion orifice through which an active agent-containing dosage unit is inserted into the pouch, the insertion orifice being positioned on the outside of the mouthpiece wall between the part to be held between the alveoli and the one end of said mouthpiece.

2. The dummy according to claim 1, wherein the pouch possesses a wall having one or more holes for delivering an active agent of a disintegrating dosage unit into the mouth of a baby.

3. The dummy according to claim 1, wherein the pouch is positioned in a lower part of the mouthpiece.

4. The dummy according to claim 1, wherein the wall of the mouthpiece has a protuberance at the orifice of the pouch to prevent the dosage unit inserted into the pouch through the orifice from escaping into the mouth of a baby.

5. The dummy according to claim 2, wherein the pouch is positioned in a lower part of the mouthpiece.

6. The dummy according to claim 2, wherein the mouthpiece has a protuberance at the orifice of the pouch to prevent the dosage unit inserted into the pouch through the orifice from escaping into the mouth of a baby.

7. The dummy according to claim 3, wherein the mouthpiece has a protuberance at the orifice of the pouch to prevent the dosage unit inserted into the pouch through the orifice from escaping into the mouth of a baby.

8. A pacifying or a feeding dummy, comprising a mouthpiece that includes a piece made of an elastic material to be held in the mouth of a baby between the tongue and the palate and a part to be held between the alveoli in the mouth of the baby, the mouthpiece having a tip end that is to be located in the mouth of the baby, the mouthpiece having an outer surface extending from the tip end to said part to be held between the alveoli in the mouth of the baby, the mouthpiece being provided with a pouch for receiving an active agent-containing dosage unit, the mouthpiece also including an insertion orifice communicating with the pouch and opening to said outer surface of the mouthpiece through which the active agent-containing dosage unit is inserted into the pouch.

9. The dummy according to claim 8, wherein the pouch possesses a wall having one or more holes for delivering an active agent of a disintegrating dosage unit into the mouth of a baby.

10. The dummy according to claim 8, wherein the pouch is positioned in a lower part of the mouthpiece.

11. The dummy according to claim 8, wherein the wall of the mouthpiece has a protuberance at the orifice of the pouch to prevent the dosage unit inserted into the pouch through the orifice from escaping into the mouth of a baby.

12. The dummy according to claim 9, wherein the pouch is positioned in a lower part of the mouthpiece.

13. The dummy according to claim 9, wherein the mouthpiece has a protuberance at the orifice of the pouch to prevent the dosage unit inserted into the pouch through the orifice from escaping into the mouth of a baby.

14. A pacifying or a feeding dummy, comprising a mouthpiece that includes a piece made of an elastic material to be held in the mouth of a baby between the tongue and the palate and a part to be held between the alveoli in the mouth of the baby, the mouthpiece having an outer surface and a tip end located in the mouth of the baby, the mouthpiece being provided with a pouch for receiving an active agent-containing dosage unit, the mouthpiece also including an insertion orifice communicating with the pouch and opening exteriorly of the mouthpiece to insert an active agent-containing dosage unit into the pouch, the insertion orifice extending transverse to a direction of extent of the pouch.

15. The dummy according to claim 14, wherein the pouch possesses a wall having one or more holes for delivering an active agent of a disintegrating dosage unit into the mouth of a baby.

16. The dummy according to claim 14, wherein the pouch is positioned in a lower part of the mouthpiece.

17. The dummy according to claim 14, wherein the wall of the mouthpiece has a protuberance at the orifice of the pouch to prevent the dosage unit inserted into the pouch through the orifice from escaping into the mouth of a baby.

18. The dummy according to claim 15, wherein the pouch is positioned in a lower part of the mouthpiece.

19. The dummy according to claim 15, wherein the mouthpiece has a protuberance at the orifice of the pouch to prevent the dosage unit inserted into the pouch through the orifice from escaping into the mouth of a baby.

* * * * *